US009383091B1

(12) United States Patent
Greco

(10) Patent No.: US 9,383,091 B1
(45) Date of Patent: Jul. 5, 2016

(54) AUTO-ILLUMINATING TOILET PAPER HOLDER

(71) Applicant: Brian N. Greco, Mount Union, PA (US)

(72) Inventor: Brian N. Greco, Mount Union, PA (US)

( * ) Notice: Subject to any disclaimer, the term of this patent is extended or adjusted under 35 U.S.C. 154(b) by 396 days.

(21) Appl. No.: 14/165,659

(22) Filed: Jan. 28, 2014

(51) Int. Cl.

| | |
|---|---|
| ***F21V 33/00*** | (2006.01) |
| ***F21S 9/02*** | (2006.01) |
| ***F21S 9/03*** | (2006.01) |
| ***F21V 23/04*** | (2006.01) |

(52) U.S. Cl.
CPC ..... *F21V 33/004* (2013.01); *F21S 9/02* (2013.01); *F21S 9/035* (2013.01); *F21V 23/0485* (2013.01)

(58) Field of Classification Search
CPC ..... F21V 33/04; F21V 23/0485; F21S 9/02; F21S 9/035
See application file for complete search history.

(56) References Cited

U.S. PATENT DOCUMENTS

| | | | | |
|---|---|---|---|---|
| 5,036,443 | A | 7/1991 | Humble et al. | |
| 5,624,025 | A * | 4/1997 | Hixon | A47K 10/32 206/233 |
| 6,000,658 | A * | 12/1999 | McCall, Jr. | A47K 10/32 242/564.2 |
| D419,012 | S | 1/2000 | Wiggins, Jr. | |
| 8,206,003 | B1 | 6/2012 | LaBarge | |
| 2004/0184273 | A1 | 9/2004 | Reynolds et al. | |
| 2008/0041711 | A1 | 2/2008 | Herber | |
| 2008/0266844 | A1 | 10/2008 | Reynolds et al. | |
| 2011/0267201 | A1 | 11/2011 | Bucha | |

* cited by examiner

*Primary Examiner* — David V Bruce
(74) *Attorney, Agent, or Firm* — Kyle A. Fletcher, Esq.

(57) ABSTRACT

An auto-illuminating toilet paper holder is mounted against a planar surface, such as a wall, and includes an auto-illumination capability. The toilet paper holder includes armatures that extend perpendicularly from a mounting plate. The armatures are parallel with one another, and support a bar member there between. The bar member is optionally spring-loaded, and is configured to support a roll of toilet paper thereon. The armatures are further defined with a bottom surface, which includes at least one illumination member thereon, and which emits light downwardly to aid an end user in collecting toilet paper when in an unlit or poorly lit environment. The illumination members are in electrical connection with a power member, and a touch sensor. The touch sensor powers the illumination members when a touching of the toilet paper holder is detected.

20 Claims, 4 Drawing Sheets

AUTO-ILLUMINATING TOILET PAPER HOLDER

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of toilet paper holders, more specifically, a toilet paper holder that has an illumination capability.

SUMMARY OF THE INVENTION

An embodiment of the disclosure meets the needs presented above by generally comprising a toilet paper holder that is mounted against a planar surface, such as a wall, and includes an auto-illumination capability. The toilet paper holder includes armatures that extend perpendicularly from a mounting plate. The armatures are parallel with one another, and support a bar member there between. The bar member is optionally spring-loaded, and is configured to support a roll of toilet paper thereon. The armatures are further defined with a bottom surface, which includes at least one illumination member thereon, and which emits light downwardly to aid an end user in collecting toilet paper when in an unlit or poorly lit environment. The illumination members are in electrical connection with a power member, and a touch sensor. The touch sensor powers the illumination members when a touching of the toilet paper holder is detected.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DETAILED DESCRIPTION OF THE EMBODIMENT

Figure 1:
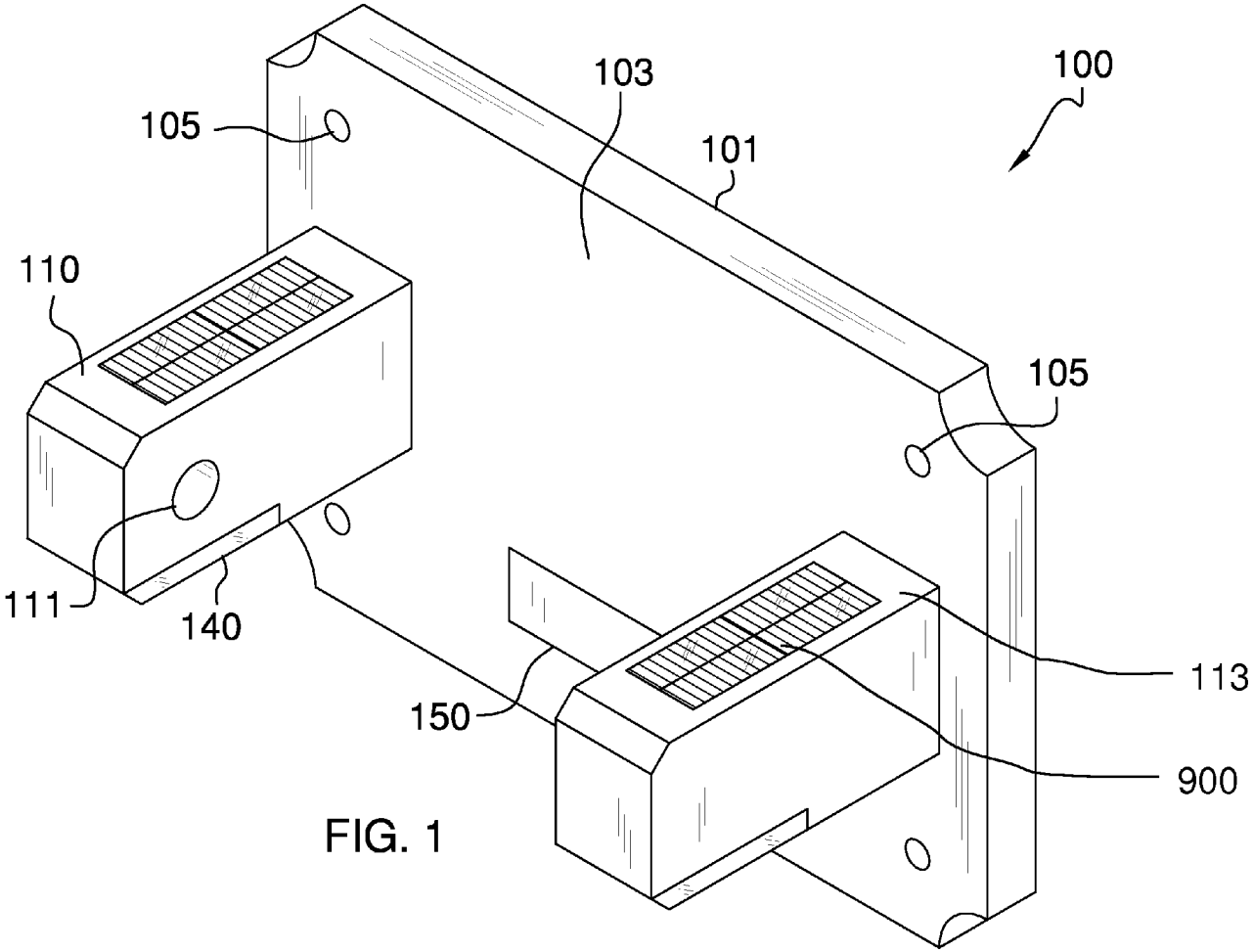
FIG. 1 is a top, perspective view of the auto-illuminating toilet paper holder.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

As best illustrated in FIGS. 1 through 5, the auto-illuminating toilet paper holder 100 (hereinafter invention) generally comprises a mounting plate 101, which is further defined with an inner surface 102 and an outer surface 103. Mounting holes 104 are strategically located on the mounting plate 101 in order to secure the invention 100 against a planar surface 200. Moreover, mounting hardware 106 is included with the invention 100, and is used to secure the mounting plate 101 to the planar surface 200. The mounting hardware 106 comprises a screw, nail, rivet, or bolt.

The outer surface 103 includes two armatures 110 that extend perpendicularly there from. The armatures 110 are generally parallel with one another, and each include a bar member cavity 111 that is oriented inwardly such that a bar member 120 is able to be installed in between the armatures 110. The bar member 120 is of an undefined bar member length 121, and is configured to support a roll of toilet paper 300 thereon.

The armatures 110 are further defined with a bottom surface 112 that includes an illumination member 140 integrated therein. The illumination member 140 comprises the use of an incandescent bulb, light emitting diode, or fluorescent bulb. The illumination member 140 directs light 400 downwardly with respect to the invention 100.

The mounting plate 101 includes a touch sensor 150 on the outer surface 103. The touch sensor 150 is in wired communication between a powering member 160 and the illumination members 140 of the armatures 110. The touch sensor 150 is able to detect a touching of the invention 100 via an end user, and upon said detection, shall direct electrical power to the illumination members 140 via the powering member 160.

Figure 2:
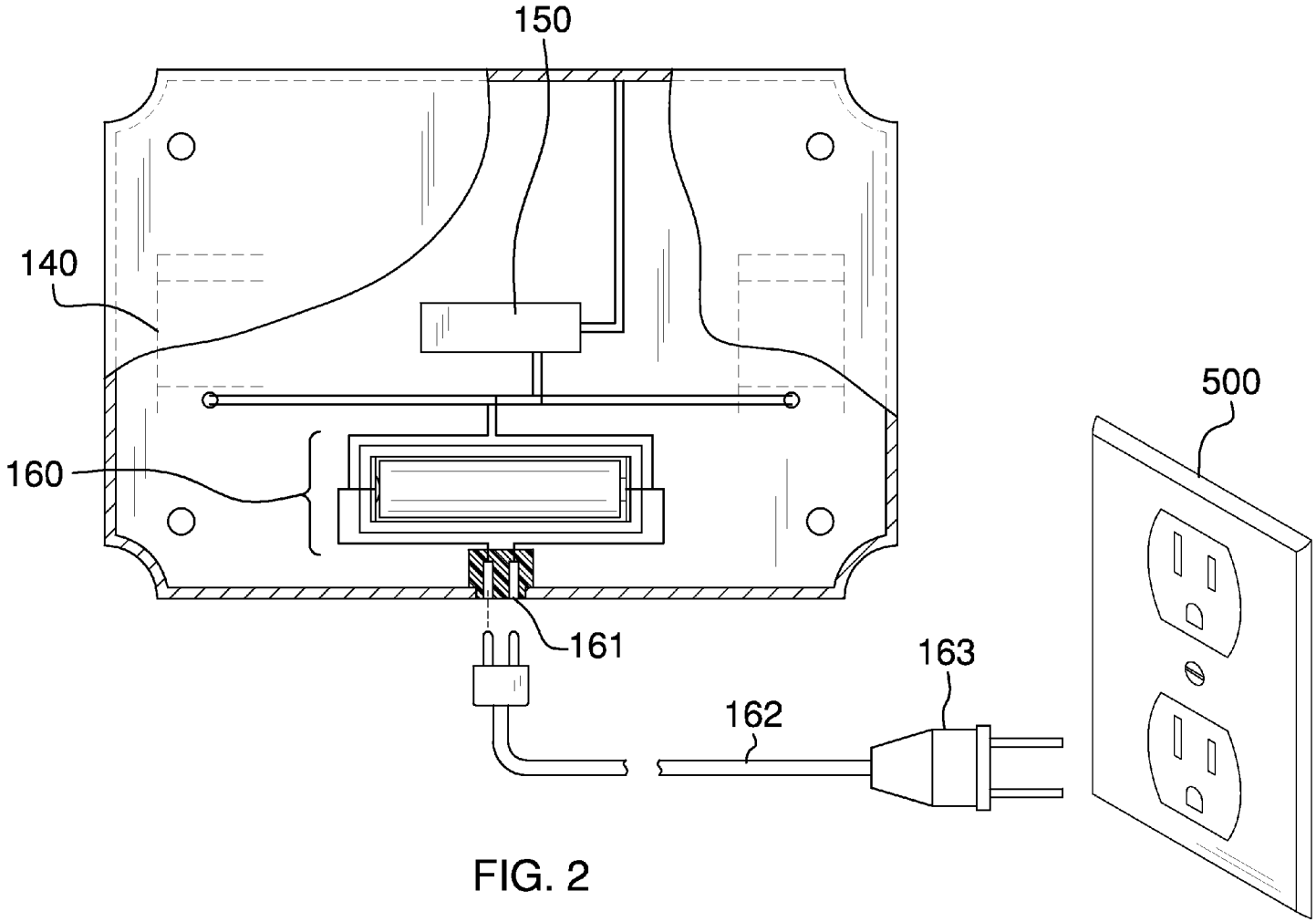
FIG. 2 is a rear view of the auto-illuminating toilet paper holder.
Figure 3:
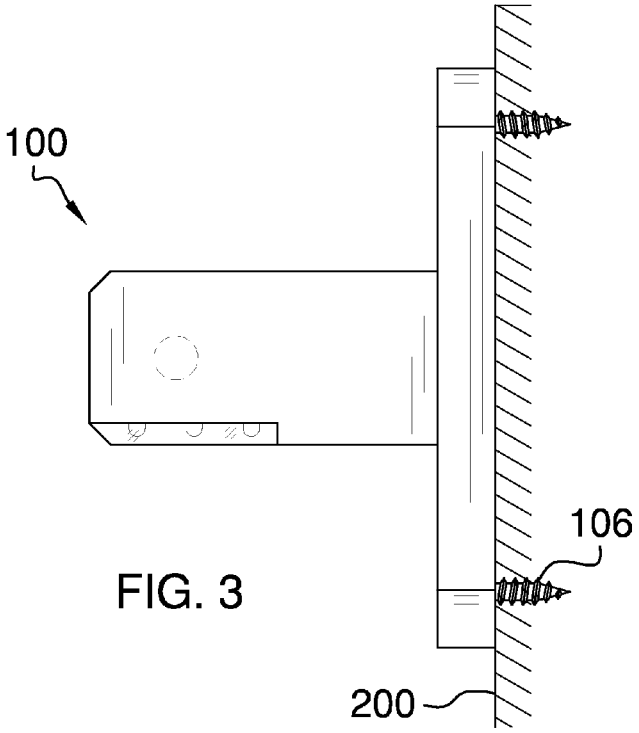
FIG. 3 is a side view of the auto-illuminating toilet paper holder.
Figure 4:
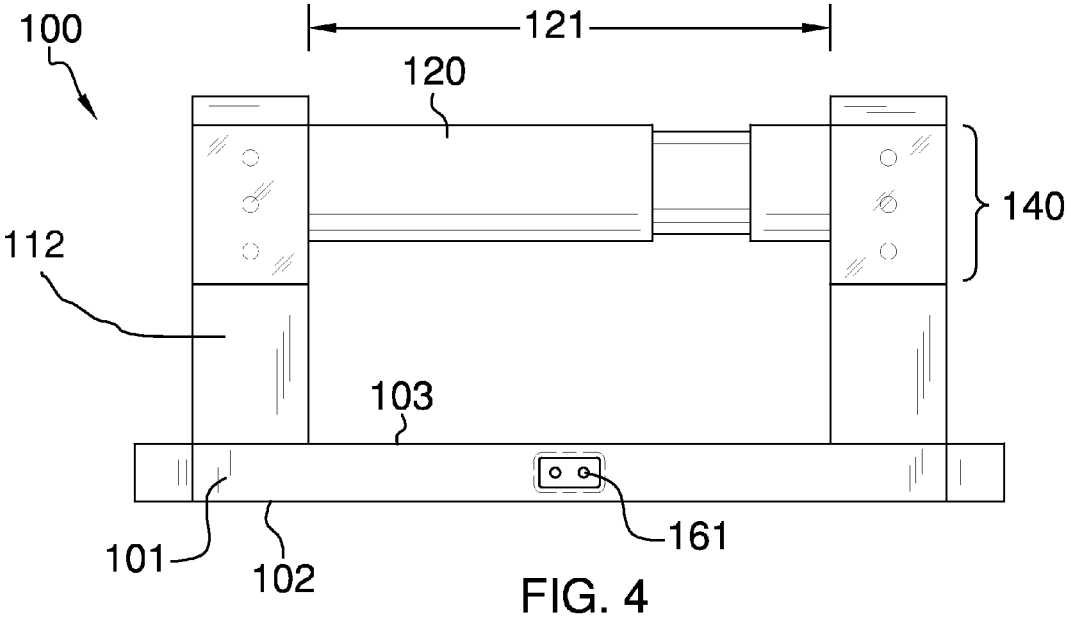
FIG. 4 is a bottom view of the auto-illuminating toilet paper holder.
Figure 5:
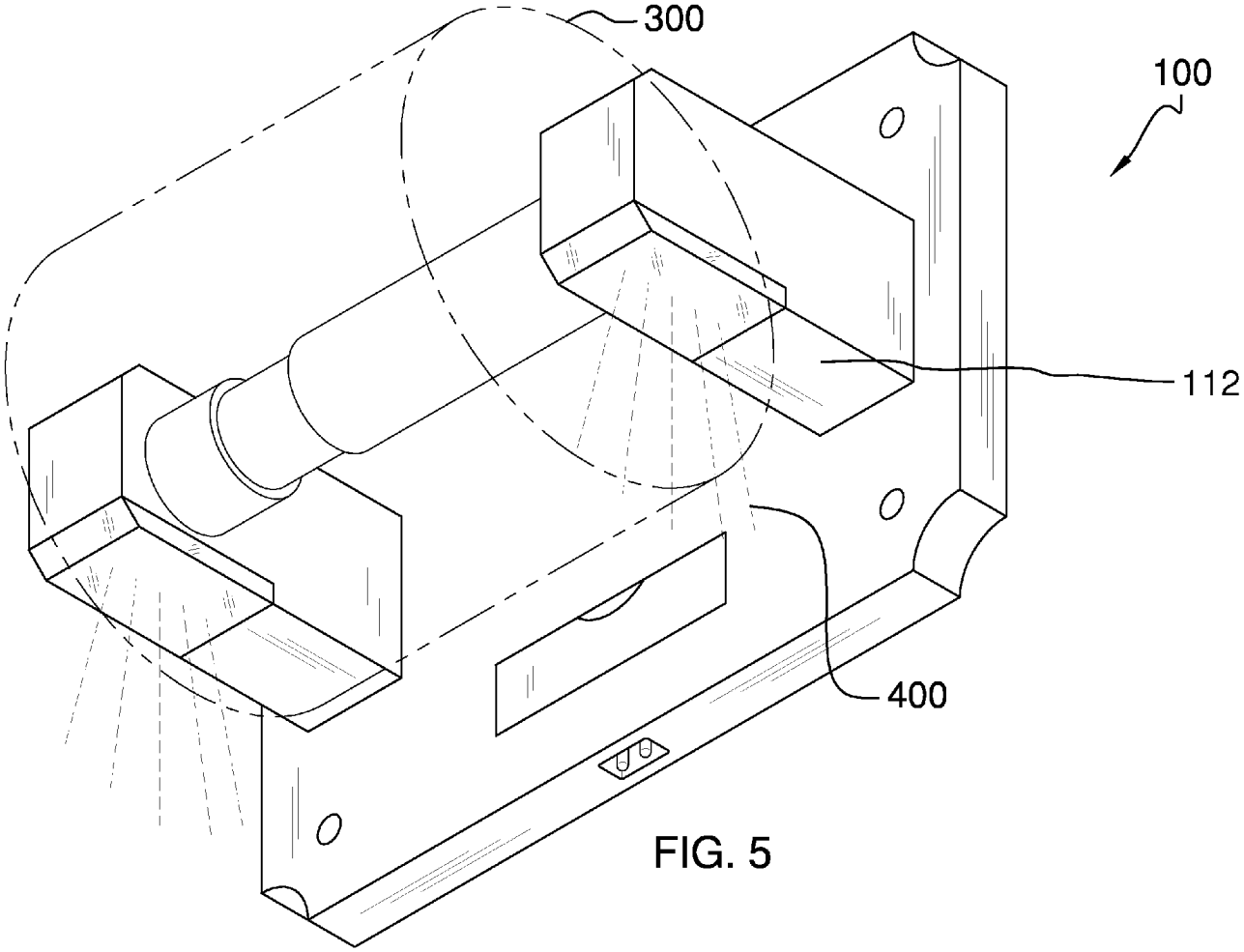
FIG. 5 is a bottom, perspective view of the auto-illuminating toilet paper holder in use with a roll of toilet paper, and depicting illumination.

Referring to FIG. 2, the powering member 160 includes at least one battery, which may be rechargeable. A battery recharge port 161 is included on the mounting plate 101, and enables a battery recharging cord 162 to connect to the battery recharge port 161. The battery recharging cord 162 includes an electrical outlet plug 163 that is configured to be plugged into a standard wall outlet 500. The battery recharging cord 162 enables the powering member 160 to be recharged or to simply rely solely on electricity to power the invention 100 via the electrical outlet plug 163.

It shall be noted that the battery recharge port 161 is located on a bottom plate surface 109 of the mounting plate 101. The location of the battery recharge port 161 on the bottom plate surface 109 insures that the battery recharging cord 162 does not interfere with the use of the touch sensor 150 nor access to the roll of toilet paper 300.

It shall be noted that a solar cell 900 may be included with the invention 100. The solar cell 900 being used to optionally operate the invention 100 or to recharge the powering member 160. The solar cell 900 may be located on a top surface 113 of one or both of the armatures 110.

With respect to the above description, it is to be realized that the optimum dimensional relationship for the various components of the invention 100, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 100.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. An auto-illuminating toilet paper holder comprising:

a mounting plate from which two armatures extend to support a bar member there between;

said bar member being configured to support a roll of toilet paper thereon; and a touch sensor is configured to detect a touching, and upon so shall power an illumination member located on at least one of the armatures;

said illumination member directs light downwardly with respect to the mounting plate.

2. The toilet paper holder according to claim 1 wherein the mounting plate is further defined with an inner surface and an outer surface.

3. The toilet paper holder according to claim 2 wherein the mounting plate includes a plurality of mounting holes that extend from the outer surface to the inner surface; wherein the inner surface and the outer surface are generally parallel.

4. The toilet paper holder according to claim 3 wherein mounting hardware is included, and is configured used to secure the mounting plate to a planar surface; wherein the mounting hardware comprises a screw, nail, rivet, or bolt.

5. The toilet paper holder according to claim 3 wherein the outer surface of the mounting plate includes the two armatures thereon; wherein the armatures extend perpendicularly from the outer surface of the mounting plate.

6. The toilet paper holder according to claim 5 wherein the armatures are generally parallel with one another, and each include a bar member cavity that is oriented inwardly such that the bar member is able to be installed in between the armatures; wherein the bar member has a bar member length, and is configured to support the roll of toilet paper thereon.

7. The toilet paper holder according to claim 6 wherein the armatures are further defined with a bottom surface that includes the illumination member integrated therein; wherein the illumination member comprises the use of an incandescent bulb, light emitting diode, or fluorescent bulb; wherein the illumination member directs light downwardly with respect to the toilet paper holder.

8. The toilet paper holder according to claim 6 wherein the mounting plate includes the touch sensor on the outer surface.

9. The toilet paper holder according to claim 8 wherein the touch sensor is in wired communication between a powering member and the illumination members of the armatures; wherein the touch sensor is configured to detect a touching, and upon said detection, shall direct electrical power to the illumination members via the powering member.

10. The toilet paper holder according to claim 9 wherein the powering member includes at least one battery.

11. The toilet paper holder according to claim 10 wherein the battery is rechargeable.

12. The toilet paper holder according to claim 11 wherein a battery recharge port is included on the mounting plate, and enables a battery recharging cord to connect to the battery recharge port.

13. The toilet paper holder according to claim 12 wherein the battery recharging cord includes an electrical outlet plug that is configured to be plugged into a standard wall outlet.

14. The toilet paper holder according to claim 13 wherein the battery recharging cord enables the powering member to be recharged or to simply rely solely on electricity to power the illumination members and touch sensor via the electrical outlet plug.

15. The toilet paper holder according to claim 14 wherein the battery recharge port is located on a bottom plate surface of the mounting plate.

16. The toilet paper holder according to claim 15 wherein at least one solar cell is included, and is used to optionally recharge the powering member or to operate the illumination member; wherein the at least one solar cell is located on a top surface of at least one of the armatures.

17. An auto-illuminating toilet paper holder comprising:

a mounting plate from which two armatures extend to support a bar member there between;

said bar member being configured to support a roll of toilet paper thereon; and a touch sensor is configured to detect a touching, and upon so shall power an illumination member located on at least one of the armatures;

said illumination member directs light downwardly with respect to the mounting plate;

wherein the mounting plate is further defined with an inner surface and an outer surface;

wherein the mounting plate includes a plurality of mounting holes that extend from the outer surface to the inner surface; wherein the inner surface and the outer surface are generally parallel;

wherein the outer surface of the mounting plate includes the two armatures thereon; wherein the armatures extend perpendicularly from the outer surface of the mounting plate.

18. The toilet paper holder according to claim 17 wherein mounting hardware is included, and is configured used to secure the mounting plate to a planar surface; wherein the mounting hardware comprises a screw, nail, rivet, or bolt; wherein the armatures are generally parallel with one another, and each include a bar member cavity that is oriented inwardly such that the bar member is able to be installed in between the armatures; wherein the bar member has a bar member length, and is configured to support the roll of toilet paper thereon; wherein the armatures are further defined with a bottom surface that includes the illumination member integrated therein; wherein the illumination member comprises the use of an incandescent bulb, light emitting diode, or fluorescent bulb; wherein the illumination member directs light downwardly with respect to the toilet paper holder; wherein the mounting plate includes the touch sensor on the outer surface; wherein the touch sensor is in wired communication between a powering member and the illumination members of the armatures; wherein the touch sensor is configured to detect a touching, and upon said detection, shall direct electrical power to the illumination members via the powering member.

19. The toilet paper holder according to claim 18 wherein the powering member includes at least one battery; wherein the battery is rechargeable; wherein a battery recharge port is included on the mounting plate, and enables a battery recharging cord to connect to the battery recharge port;

wherein the battery recharging cord includes an electrical outlet plug that is configured to be plugged into a standard wall outlet; wherein the battery recharging cord enables the powering member to be recharged or to simply rely solely on electricity to power the illumination members and touch sensor via the electrical outlet plug; wherein the battery recharge port is located on a bottom plate surface of the mounting plate.

20. The toilet paper holder according to claim 19 wherein at least one solar cell is included, and is used to optionally recharge the powering member or to operate the illumination member; wherein the at least one solar cell is located on a top surface of at least one of the armatures.

* * * * *